US005438765A

United States Patent [19]

Tyrmi et al.

[11] Patent Number: 5,438,765

[45] Date of Patent: Aug. 8, 1995

[54] METHOD AND APPARATUS FOR ELIMINATING THE FLUTTER OF A PAPER WEB IN THE DRYER SECTION OF A PAPERMAKING MACHINE BETWEEN TWO SINGLE FELT CONFIGURATIONS THEREIN

[75] Inventors: Jouko Tyrmi, Tampere; Timo Haverinen, Masku, both of Finland

[73] Assignee: Valmet Paper Machinery Inc., Helsinki, Finland

[21] Appl. No.: 56,856

[22] Filed: May 4, 1993

[51] Int. Cl.[6] ..... F26B 3/24

[52] U.S. Cl. ..... 34/456; 34/115; 34/458

[58] Field of Search ..... 34/114, 115, 116, 117, 34/454, 455, 456, 457, 458

[56] References Cited

U.S. PATENT DOCUMENTS

| | | | |
|---|---|---|---|
| 4,698,919 | 10/1987 | Wedel . | |
| 4,934,067 | 6/1990 | Wedel . | |
| 5,065,529 | 11/1991 | Skaugen et al. | 34/117 |
| 5,101,577 | 4/1992 | Wedel | 34/117 |
| 5,146,696 | 9/1992 | Mayer et al. | 34/117 |

FOREIGN PATENT DOCUMENTS 0426607 5/1991 European Pat. Off. .

*Primary Examiner*—Henry A. Bennet

*Attorney, Agent, or Firm*—Pollock, Vande Sande & Priddy

[57] ABSTRACT

The present invention is a method and apparatus for eliminating the flutter of a paper web in the dryer section of a papermaking machine between two single felt configurations in which the web is transferred from a dryer fabric of a first configuration onto a dryer fabric of a second configuration along a common run of the fabrics, the transfer being effected from one fabric to the other by means of a vacuum transfer roll, with the second configuration dryer fabric being brought into contact with the web and around which the fabric is winding, whereby on the side of the first configuration dryer fabric upstream of a contact point between the web carried thereon and the second configuration dryer fabric winding around the vacuum transfer roll there is provided a vacuum zone defined by the first configuration dryer fabric for retaining the web in contact with the first configuration dryer fabric. At a location downstream of the contact point in the traveling direction of the first configuration dryer fabric, air is blown from the side of the first configuration dryer fabric released from the web through the fabric into a gap formed between the second configuration dryer fabric lying on the vacuum transfer roll together with the web and the first configuration dryer fabric released from the web.

16 Claims, 11 Drawing Sheets

METHOD AND APPARATUS FOR ELIMINATING THE FLUTTER OF A PAPER WEB IN THE DRYER SECTION OF A PAPERMAKING MACHINE BETWEEN TWO SINGLE FELT CONFIGURATIONS THEREIN

FIELD OF THE INVENTION

The present invention relates to a method and apparatus for eliminating the flutter of a paper web in the section of a papermaking machine between two single fabric configurations therein.

BACKGROUND OF THE INVENTION

The operational speeds of papermaking machines have continuously increased and are already approaching 1600 m/min. At such speeds, the flutter of a web and especially its threading becomes a serious problem impairing the runability. Supporting and transferring a web from a press section to a dryer section and within one and the same single fabric configuration can be controlled by the application of prior known technology. Although a single fabric run is well capable of supporting a web even at high running speeds, it will only be subjected to one-sided drying within one and the same single fabric configuration, which is why the dryer section must include two successive single fabric configurations. Transfer and threading between these configurations will thus present a problem. Also a normal double fabric run may include spaces between configurations, wherein the web is unsupported. An effort is made to transfer a tail (threading strip) and a web between all configurations of a dryer section without any contact between dryer fabrics since there is a slight speed difference between the configurations for the reason that the web must be drawn by adjusting the speed difference of the dryer configurations. During normal operation, the web is unsupported over this span subjecting the web to flutters which may lead to web breakage. In terms of quality, the flutters also lead to undesired characteristics. Drawing of a paper web or sheet in an open span causes shrinkage of the web in the cross-machine direction. As for threading of a paper web, on the other hand, the transfer from one dryer configuration to the next must be effected by using special threading ropes, which requires a plurality of pulleys involving continuous maintenance. In addition, wearing and breakages of the ropes require shutdown of a papermaking machine for replacing the ropes. Furthermore, the transfer of a tail over to another configuration by using ropes is not always certain and requires precise adjustment of the pulleys and ropes.

An open span or draw, not supported by a web between the configurations has been eliminated e.g., for example, by means of a solution disclosed in U.S. Pat. No. 4,934,067. In this reference, a web or a tail can be supported by dryer fabrics when passing the same across the span between configurations from one configuration to another. However, a drawback in this solution is that the web travels a long way supported only by the fabrics, whereby the air currents and pressure differences occurring in spaces between configurations may remove the web from the fabric. The shrinkage of a web in the cross-machine direction is also more likely to take place.

SUMMARY OF THE INVENTION

An object of the invention is to provide a method and an apparatus for delivering a web as well as a tail in a supported condition from one configuration to another without the above drawbacks. In order to achieve this object, a method of the invention is primarily characterized by the features set forth in the following. The transfer is effected from the dryer fabric of a first configuration to that of a second configuration by means of a vacuum transfer roll, around which the dryer fabric of the second configuration travels, and furthermore, a vacuum is generated on the side of the first-configuration dryer fabric upstream of the contact point between a web carried thereon and the second-configuration dryer fabric winding around the vacuum transfer roll. The web and tail can be well retained on dryer fabrics across the space between configurations and there is no zone at the transfer point where the web would be exposed to air currents while supported merely by a dryer fabric. The space between configurations does not include an open draw, wherein the web would be unsupported, and a speed difference between the fabrics cannot impede the transfer, as the latter is affected at a single point or over just a short distance on the periphery of a vacuum transfer roll. In addition, threading can be effected without threading ropes and related accessories.

According to one preferred embodiment, air is blown through the fabric released from the web and located downstream of the vacuum transfer roll, the blow being directed at the web on the vacuum transfer roll for securing the transfer from one fabric to another. In addition, the blow can be partially effected by means of nozzles for creating a vacuum through ejection effect.

On the other hand, an apparatus of the invention is characterized by the features set forth in the following. The apparatus includes a vacuum transfer roll for shifting a web from a first fabric onto a second fabric winding around the roll, as well as a surface facing towards the first fabric upstream of the roll, and also blow means for generating a vacuum in a space between the fabric and the surface. This produces the above vacuum zone having the above positive effects.

According to one preferred embodiment for the apparatus, the first-fabric side includes blow means adapted to produce an air flow through a section of the first fabric downstream of the vacuum transfer roll. This is to secure the transfer of the web onto the second fabric and its retention on the fabric. According to one preferred embodiment, some of the nozzles using an ejection effect to create a vacuum prevailing upstream of the vacuum transfer roll are directed towards a plenum zone generating the flow occurring through the fabric.

In addition, the apparatus includes preferred embodiments, which are associated with the quantitative distribution of vacuum- and plenum-creating air currents in the longitudinal direction and cross machine direction and which are described later.

BRIEF DESCRIPTION OF THE DRAWINGS

The invention will be described in the following in detail with reference made to the accompanying drawings. In the drawings.

DETAILED DESCRIPTION OF THE PREFERRED EMBODIMENTS

Figure 1:
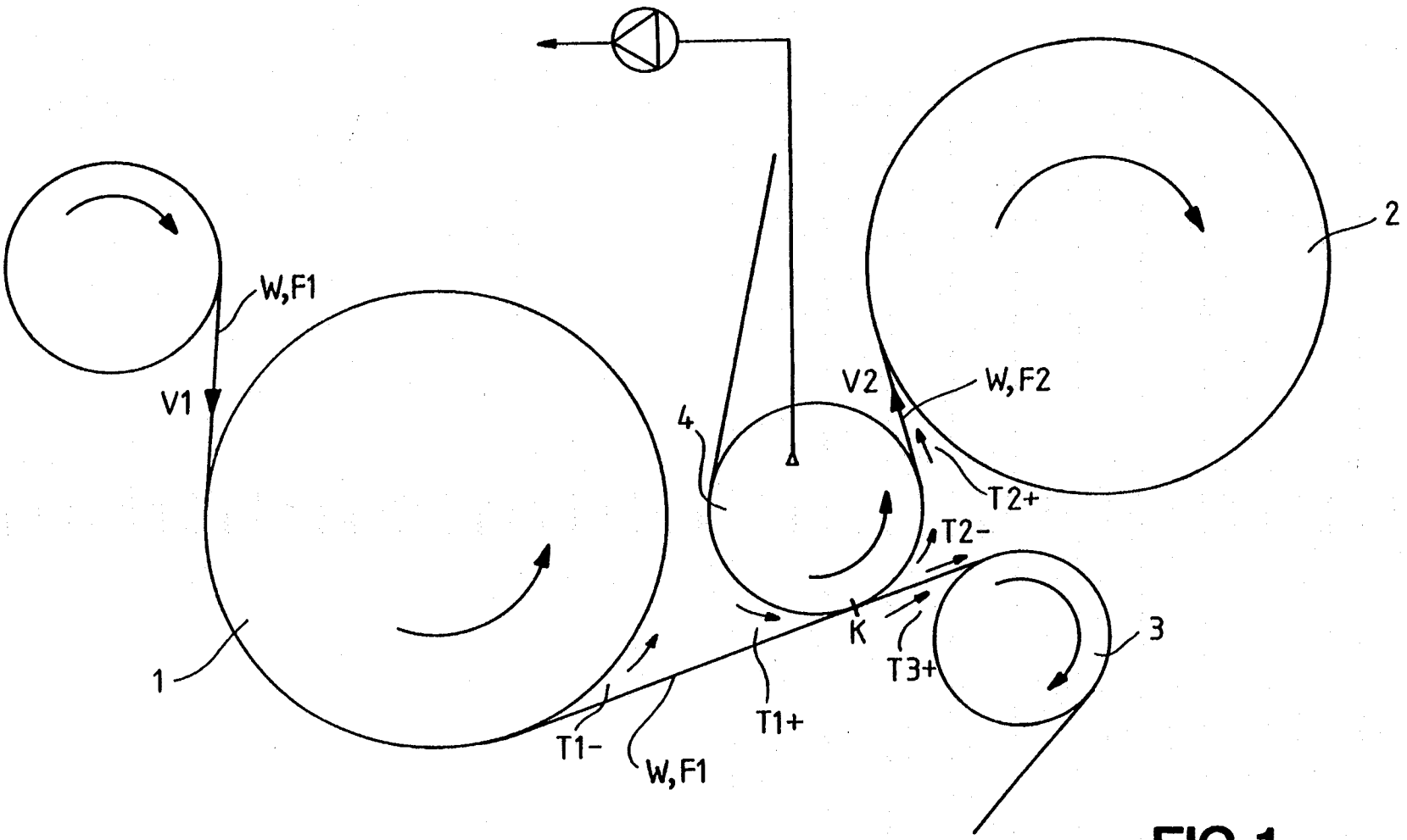
FIG. 1 illustrates the development of plenums and vacuums in shafts defined by a cylinder, a vacuum roll, and dryer fabrics providing that the fabrics are impervious.

FIGS. 1–6 illustrate the general structure of a transfer zone between single felt configurations comprising two tiers of cylinders. A web W runs from a downstream cylinder 1 included in a first dryer configuration supported by a first dryer fabric F1. At point K, web W receives thereon a second dryer fabric F2, included in a second dryer configuration and winding along the jacket of a vacuum transfer roll 4, web W shifting upon and being supported by the second dryer fabric for passing the web to a first dryer cylinder 2 included in the second configuration. Downstream of point K, fabric F2 uncovered by web W travels around a reversing roll 3, whose position can be used for adjusting the winding sector of fabric 2 upon vacuum transfer roll 4. In FIGS. 1–6, fabric F2 is in tangential contact with roll 4 at point K, at which web W transfers from one fabric onto the other.

In FIGS. 1–6, the vacuum transfer roll 4 is positioned roughly in line with a cylinder included in the tier which also includes downstream cylinder 1 of the first configuration. Accordingly, roll 4 is in line with the tier of cylinders including cylinders around which fabric F2 and web W are winding between cylinders of the tier which includes upstream cylinder 2 of the second configuration.

As shown in FIG. 1, the speed of fabric F1 and web W as well as the peripheral speed of cylinder 1, designated by reference character V1, serve to induce a vacuum T1- in a gap formed by the cylinder and the fabric section extending therefrom. A gap between vacuum transfer roll 4 and second fabric F2 as well as first fabric F1 generates on the supply side a plenum or over-pressure T1+ and on the delivery side a vacuum or underpressure T2- by virtue of the respective speeds. On the other hand, a gap between second fabric F2 and cylinder 2 generates on the supply side a plenum T2+ as a result of the speed of fabric F2 and web W as well as the peripheral speed of cylinder 2, the latter being designated by reference character v2. The same factors serve to generate a plenum T3+ between fabric F1 and reversing roll 3.

Figure 2:
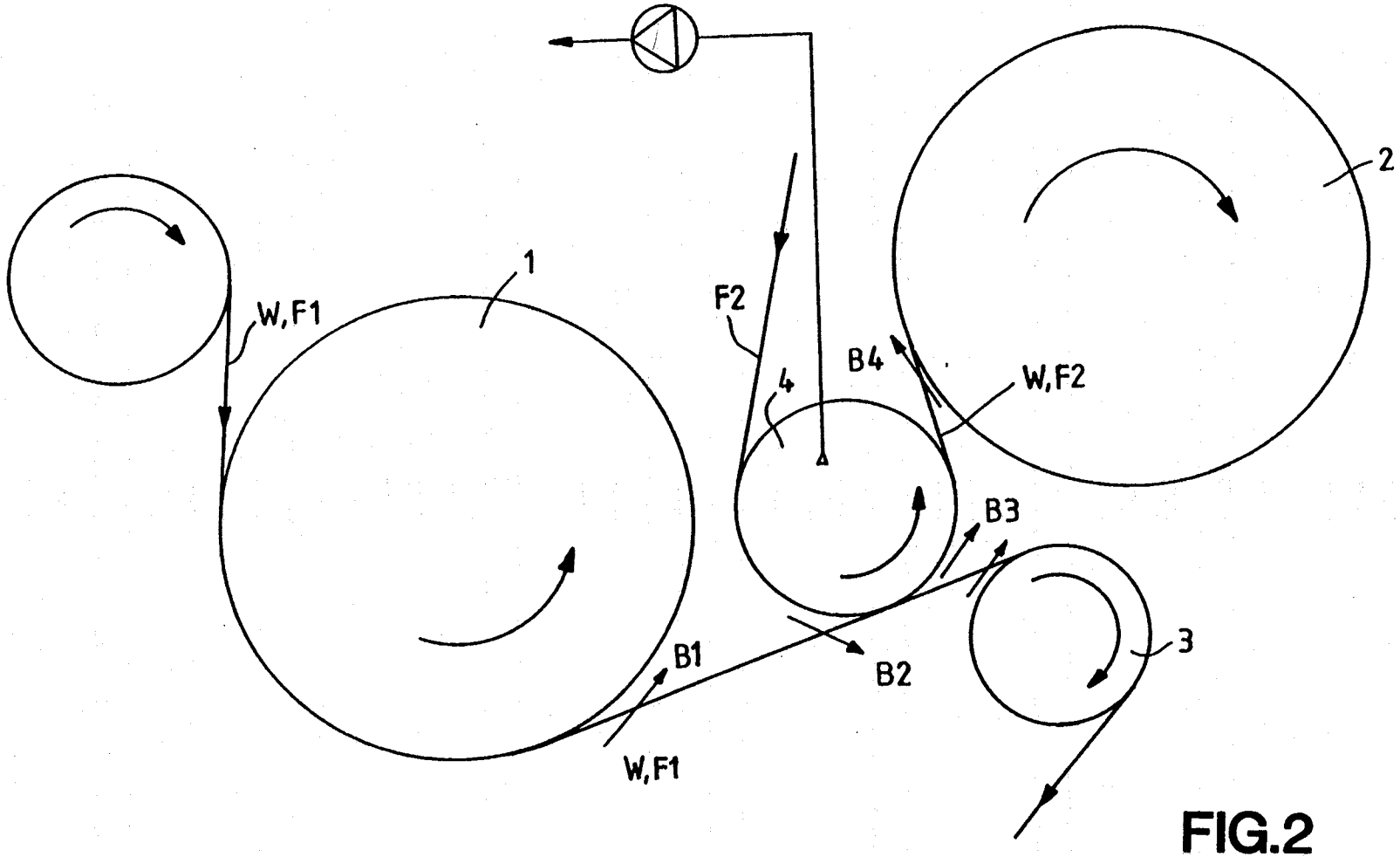
FIG. 2 illustrates the air currents produced by plenums and vacuums providing that the fabrics are pervious to air.

In FIG. 2, wherein fabrics F1 and F2 are previous to air, the vacuum T1- serves to produce a current B1 through fabric F1 towards the corresponding gap, the plenum T1+ produces a current B2 from the corresponding gap through fabric F1, the plenum T3+ and vacuum T2- produce a current B3 through fabric F1 from plenum gap to vacuum gap, and the plenum T2+ produces a current B4 through fabric F2 from the corresponding gap.

The following describes how to eliminate the flutter of web W caused by currents B1, B2 and B3 in the transfer zone.

As for the terminology employed herein, it should be noted that the first configuration and the second configuration as well as the first fabric and the second fabric refer to any two successive configurations or groups or fabrics. In addition, the term web is intended to cover also webs that are narrower than a full-width web, including tails of the web (threading strips), whose transfer can also be effected by applying the present invention. At certain points hereinafter, the description will deal with some special applications intended for a tail. Further, the term fabric refers to any web support pervious to air, and the term felt is used in such conventional names of dryer sections as single felt configuration and double felt configuration.

Figure 3:
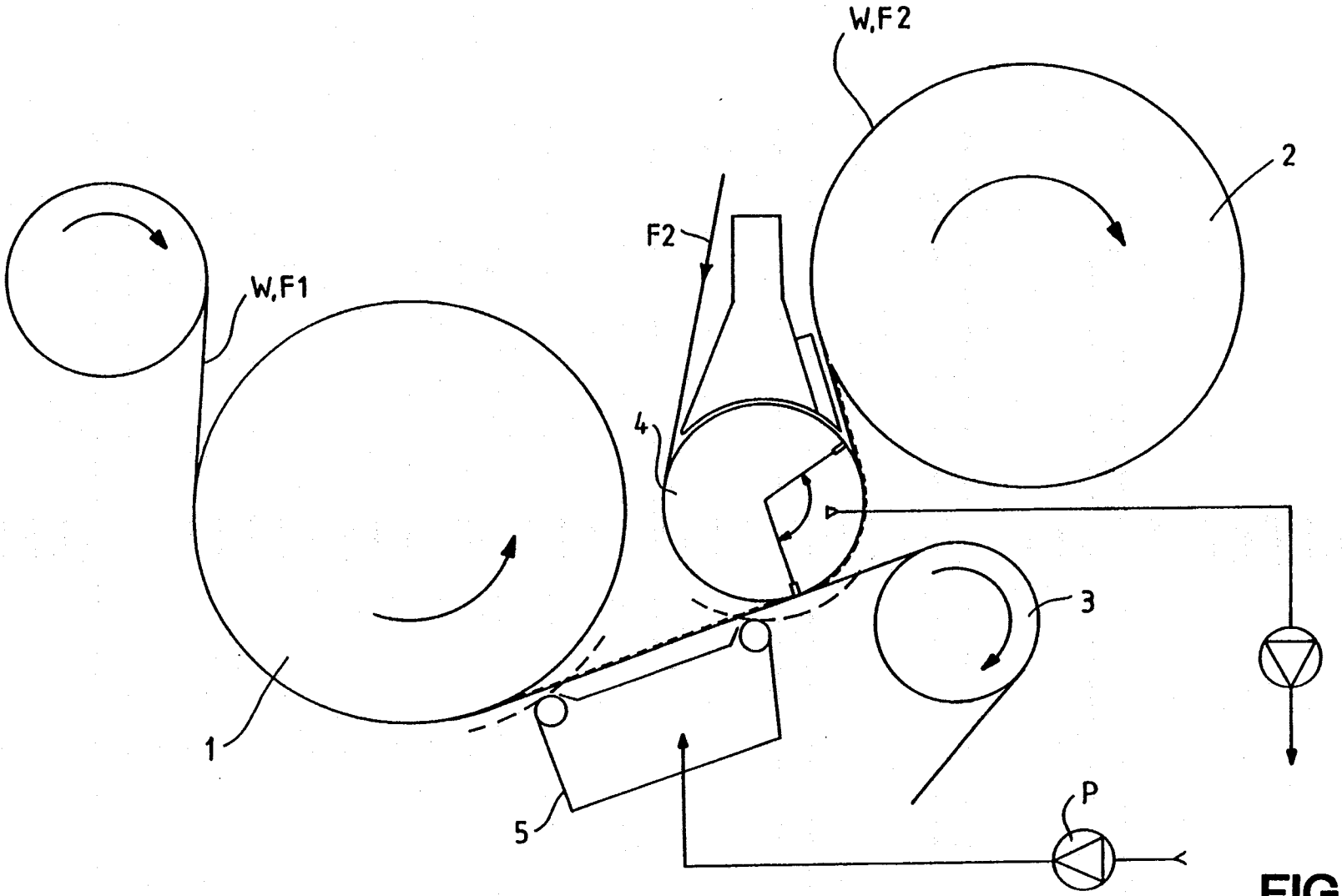
FIGS. 3, 4, 5 and 6 are sectional views in the web traveling direction, showing the present invention positioned between the single felt configurations in a dryer section.
Figure 4:
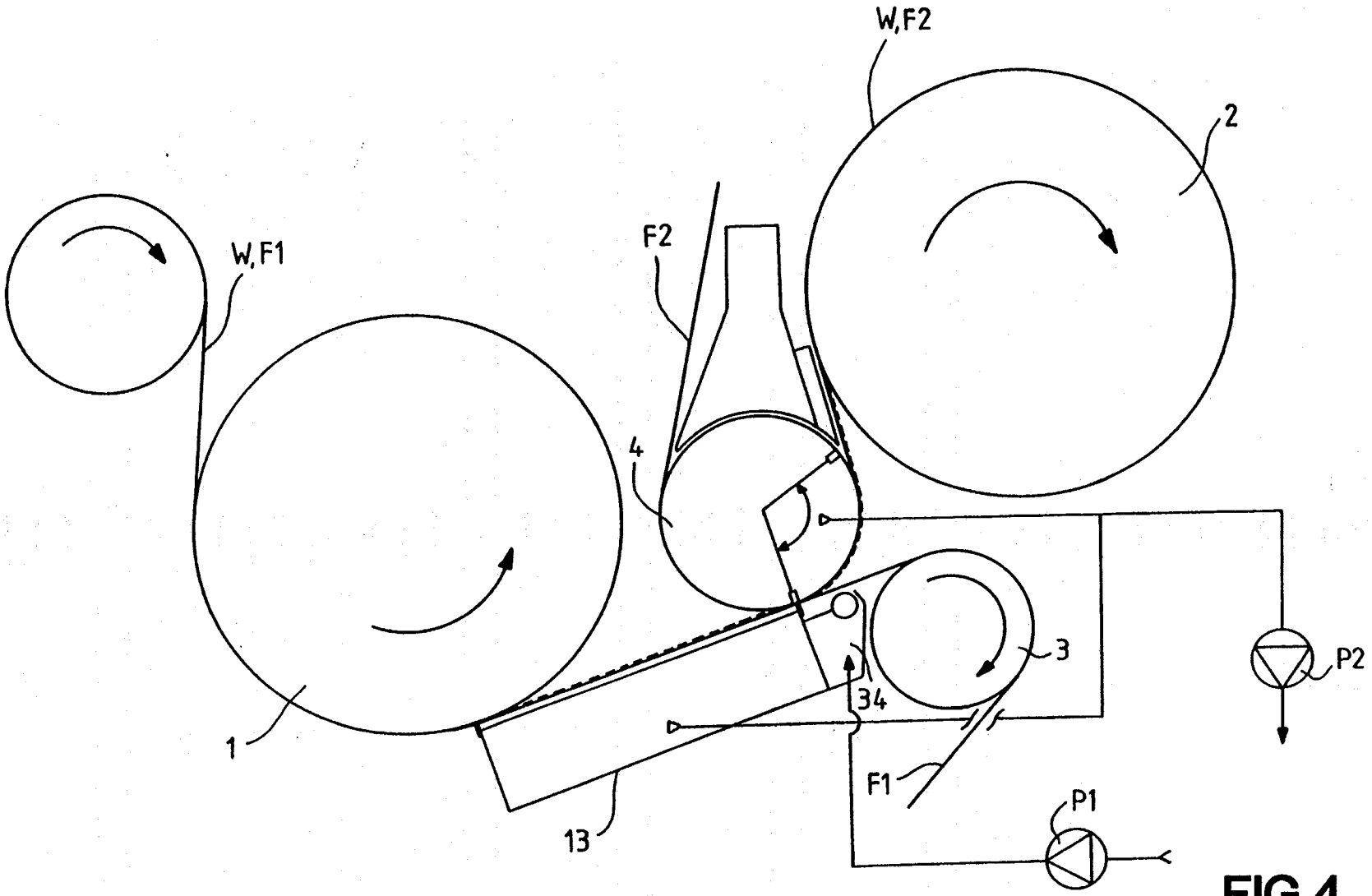
Figure 7:
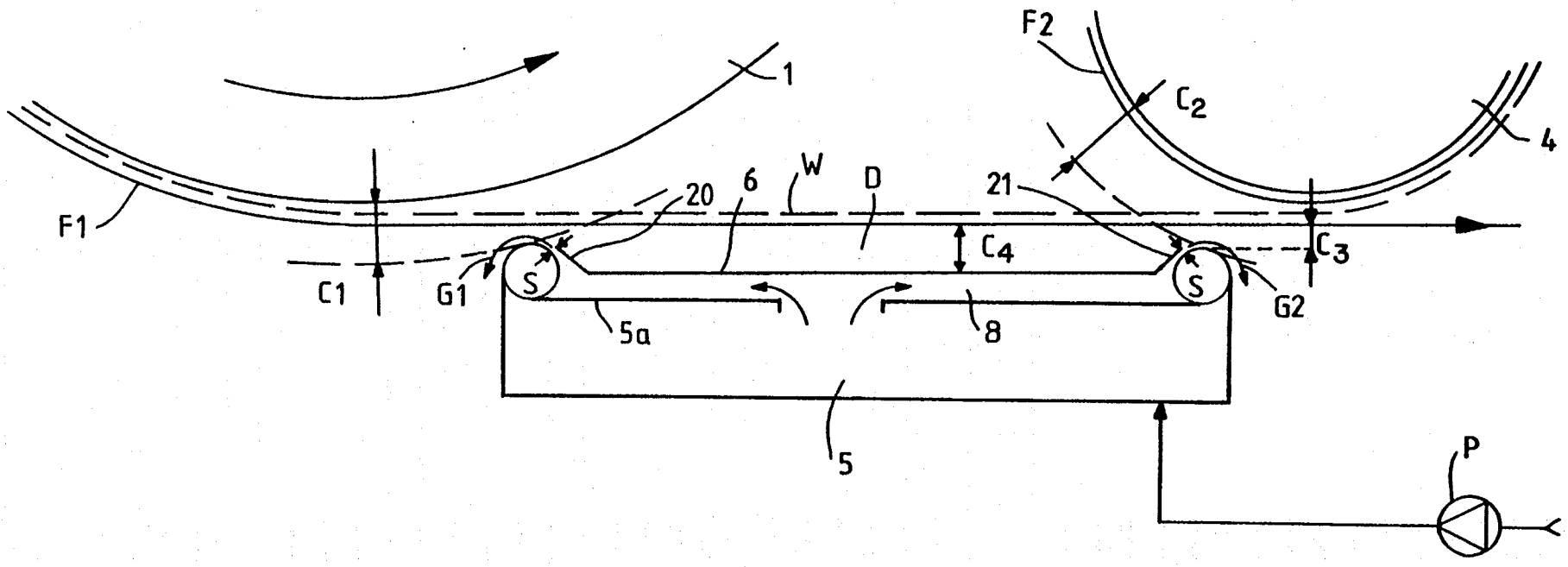
FIGS. 7 and 8 show an apparatus of FIG. 3 in more detail as a section in the longitudinal direction and cross machine direction.
Figure 8:
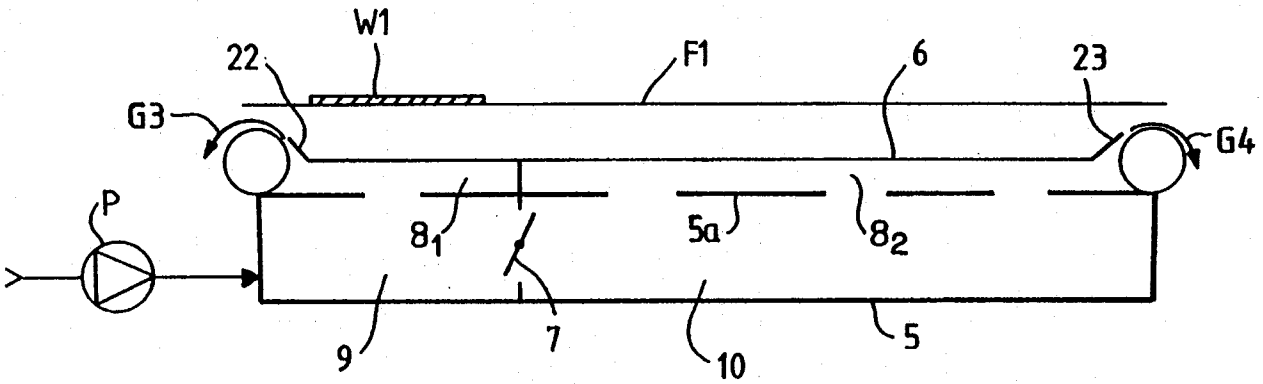

As shown in FIGS. 3, 7 and 8, on the side of fabric F1 along a section extending between cylinder 1 and roll 4 a blow box 5 is mounted, having a surface, so-called bearing surface 6 which faces towards this section of fabric F1. Surface 6 is defined by a slit orifice 20 directed against the fabric traveling direction and located crosswise of the fabric at the end of the fabric section adjacent to cylinder 1, a slit orifice 21 directed in the fabric traveling direction and also crosswise of the felt at the end adjacent to roll 4, as well as slit orifices 22 and 23 located adjacent to the fabric edges, directed crosswise and extending parallel to the edges. The slit orifice of blast nozzles 20 . . . 23 included in blow box 5 has a width S which is generally within the range of 1 . . . 8 mm, preferably about 1 . . . 5 mm. Slit orifices 20–23 as well as the slit orifices described later operate on the Coanda-principle. One edge of the slit orifice extends as a surface, curving in the blowing direction and generally having a radius of 20–50 mm, preferably 20–40 mm. Thus, by virtue of the Coanda-effect, the current or flow to be blown from the nozzles follows the above curving surface. Slit orifices 20–23 are directed away from the zone between surface 6 and fabric F1 such that the gap between the other edges thereof (curving surface) and the fabric is narrower than the gap between surface 6 and the fabric. Air jets G1 . . . G4 discharging from slit orifices 20 . . . 23 apply their ejection effect to suck air therealong from the space between bearing surface 6 and fabric F1 generating vacuum therein.

A wall 5*a* is used to provide box 5 with a lower section 8, defined by the wall forming bearing surface 6 and having nozzles 20–23 mounted on the edges thereof. The air flow delivered by a fan P proceeds by way of a duct into box 5, from which it passes through an opening in wall 5*a* into section 8 for flowing along a path parallel to wall 5*a* and bearing surface 6 to the nozzles.

Since fabric F1 is pervious to air but web W is substantially impervious to air, web W is attracted into contact with the fabric and thus the web runs in a stable fashion between cylinder 1 and vacuum roll 4. Blow box 5 is set in parallel with fabric F1 such that the distance of bearing surface 6 from fabric F1 (distance $C_4$) is preferably approximately 10–25 times the width S of slit orifices. Thus, the crosswise currents or flows between bearing surface 6 and fabric F1 are relatively insignificant even in a threading situation, when air is only blown into a section $8_2$ through a chamber 9, as described hereinafter. The distance of box from fabric F1, that is the shortest distance of the second edges of slit orifices therefrom (distance $C_3$), is generally 5–10 times, preferably approximately 5–7 times the width S of slit orifices. In addition, the position of the box is affected by the necessary safety distances between cylinder 1 and blow box 5 (distance $C_1$) as well as between vacuum roll 4 and blow box 5 (distance $C_2$).

FIG. 8 illustrates a box 5 as a section in the cross-machine direction. The blow box includes chambers 9 and 10, which are separated from each other in the crosswise direction and of which chamber 9 is located in a narrow area at the fabric edge on the service side of a machine. A fan P supplying air into the box is coupled with this chamber. Chamber 9 is in communication with the edge-mounted nozzle 22 as well as with nozzles 20 and 21 of a corresponding width. The nozzles 20 and 21 as well as edge nozzle 23 are in communication with chamber 10, into which air is supplied from chamber 9 through an opening in a partition, adapted to separate the chambers and provided with a regulating damper 7. Section 8 is respectively divided into a section $8_1$ communicating with chamber 9 and a section $8_2$ communicating with chamber 10. In a threading situation, the air flow coming into chamber 10 can be shut off by means of the regulating damper 7, whereby the air flow coming into chamber 9 increases and, accordingly, the blasting rates increase from the nozzles aligned with the chamber, resulting in an increased vacuum across chamber 9. The purpose of chamber 9 located at the edge is to facilitate the run of a tail W1 at this particular location. The width of chamber 9 exceeds that of tail W1, generally 400–1500 mm, preferably 500–800 mm.

For the duration of threading reversing roll 3 can be lifted such that the underpressure of vacuum transfer roll 4 attracts tail $W_1$ into contact with fabric F2 for the trouble-free passage of a tail from one configuration to another.

FIGS. 4, 9, 10 and 11 illustrate an embodiment of the invention, wherein the web support between cylinder 1 and vacuum roll 4 is effected by means of a vacuum box 13 as well as the blowing of a tail from one configuration to another.

Figure 9:
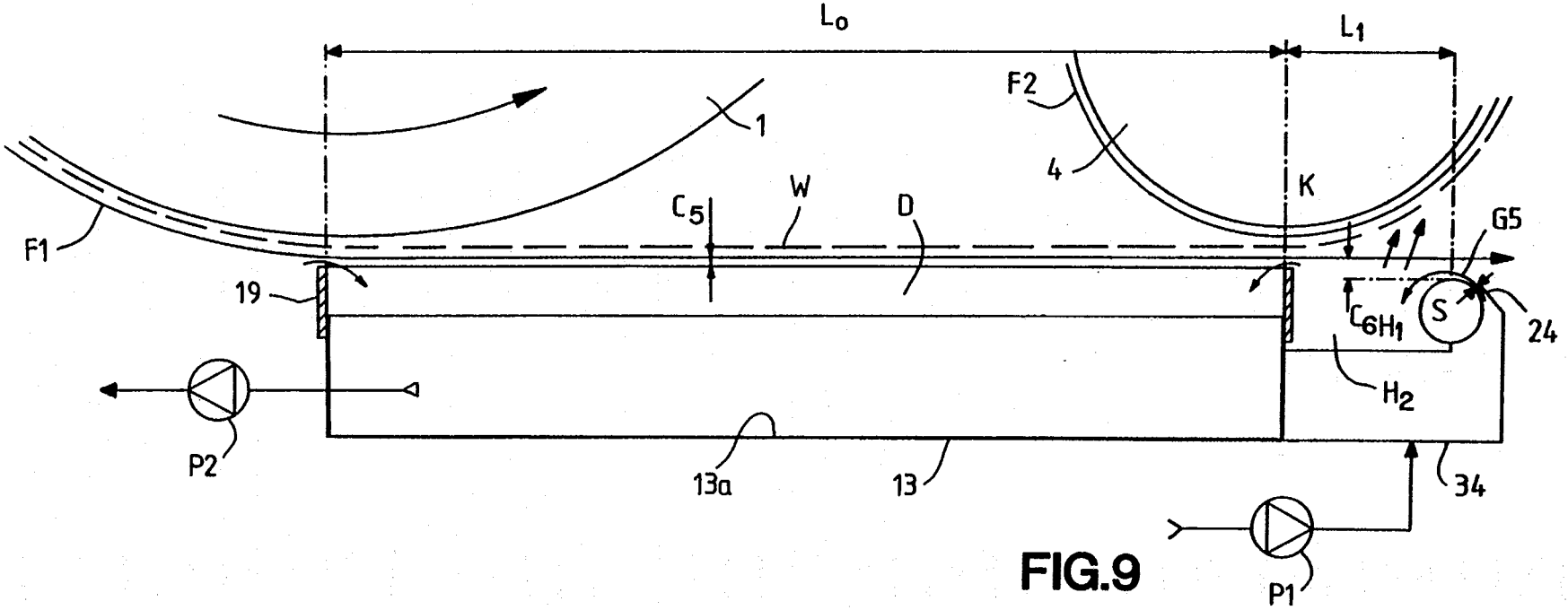
FIGS. 9, 10 and 11 show an apparatus of FIG. 4 in more detail as a section in the longitudinal direction and cross machine direction.

As shown in FIG. 9, a vacuum box 13 is connected to a fan P2 for sucking a vacuum into a space between a box bottom surface 13*a* and fabric F1. The ends and sides of the box are provided with elastic sealings 19, made of a resilient material, for example, rubber or felt, between the top edges of end walls and side walls and the fabric F1. The sealings need not be in contact with fabric F1, but a gap $C_5$ therebetween is typically in the order of 3–20 mm. The box has a first end located at a point where fabric F1 and web W disengage from cylinder 1 and an opposite end at point K where second fabric F2 comes into contact with web W. When a vacuum block is used to apply suction, the underpressure retains the web in contact with fabric F1 across the entire open space (distance $L_o$) existing between cylinder 1 and vacuum roll 4.

Figure 10:
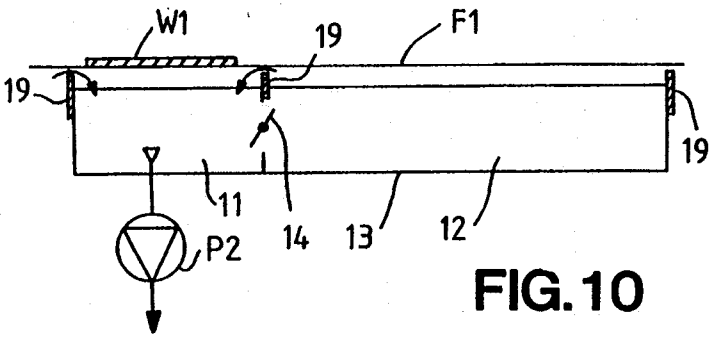

As shown in FIG. 10, it is possible, if necessary, to construct on the service side of box 13 over a certain width at the fabric edge a separate compartment 11 for accommodating the vacuum block of fan P2. The vacuum of compartment 11 can be increased by closing a damper 14 regulating the communication with a main compartment 12 making up the rest of the box interior for preventing the flow of air from compartment 12. The above arrangement is capable, if necessary, of producing a stronger vacuum on the service side within the area of tail W1. The width of compartment 11 is generally 400–1500 mm, preferably 500–800 mm.

Figure 11:
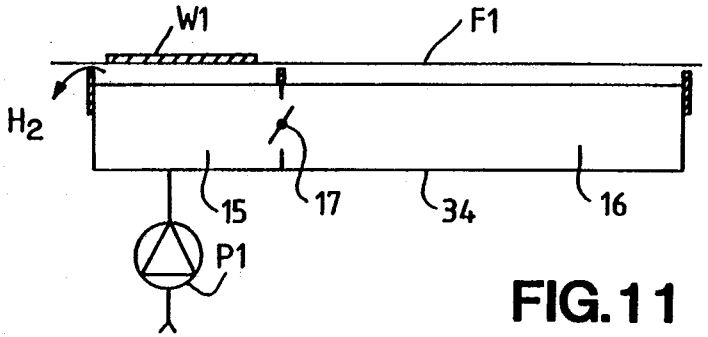

FIGS. 9 and 11 illustrate components for acting on the run of a web downstream of point K. Box 13 has an extension in the traveling direction of fabric F1 in the form of a box 34, having a fan P1 connected therewith. The end of box 34 is provided with a transverse slit orifice 24, located a little distance downstream of point K and directed against the traveling direction of fabric F2. The transfer of a web and a threading strip from fabric F1 onto fabric F2 can be effected by blowing air from slit orifice 24. The slit orifice has a width S generally within the range of 1 . . . 8 mm, preferably about 1 . . . 5 mm. An air jet $H_1$ discharging from the slit orifice produces an over-pressure in a space $H_2$, formed between the fabric-facing wall of box 34 and the fabric. The over-pressure forces web W or tail W1 to leave fabric F1 for fabric F2. For a more effective threading box 34 is divided into sections 15 and 16 in accordance with the above principle. For the duration of threading, a damper 17 between the sections can be closed, if necessary, for so increasing the over-pressure within the narrower section 15 which is in alignment with tail W1. The side edges of box 34 are also provided with sealings 19. The width of section 15 is generally 400–1500 mm, preferably 500–800 mm. In the longitudinal machine direction, the length of over-pressure or plenum zone $H_2$ (distance $L_1$) is generally 100–500 mm, preferably 100–300 mm.

Figure 5:
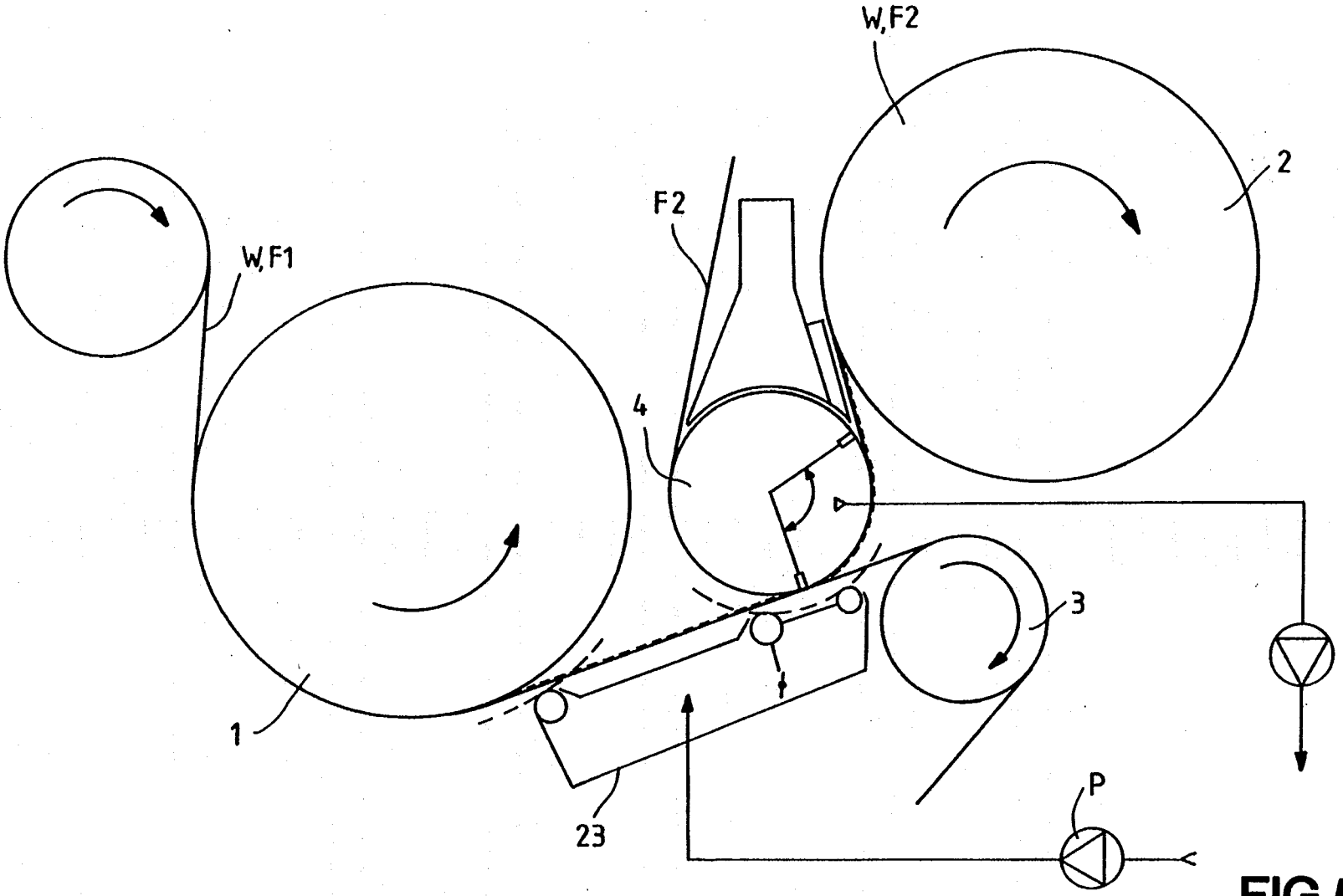
Figure 6:
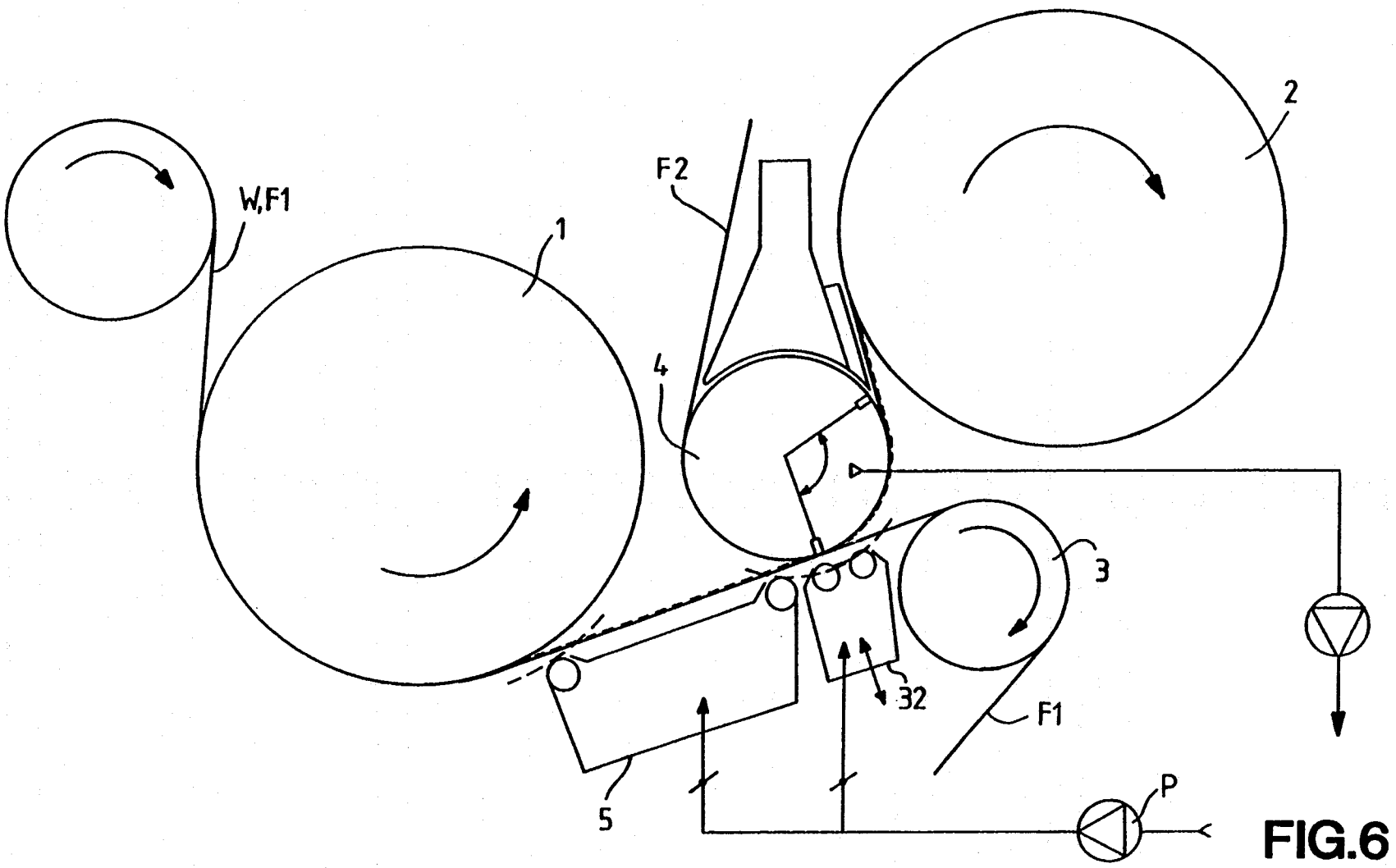
Figure 12:
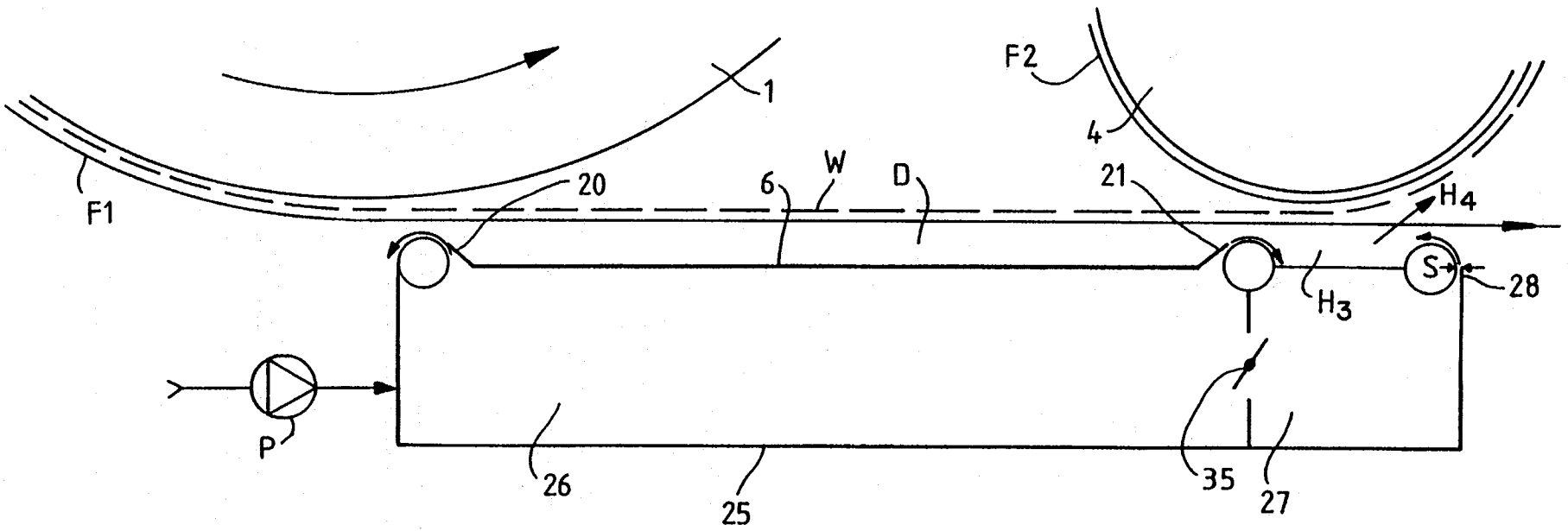
FIGS. 12 and 13 show an apparatus of FIG. 5 in more detail as a section in the longitudinal direction and cross machine direction.

FIGS. 5 and 12 illustrate an embodiment of the invention, wherein the web support between cylinder 1 and vacuum roll 4 is effected by means of a blow box 25 and the transfer of a web as well as a tail from one configuration to another is enhanced by means of blowing actions.

Figure 13:
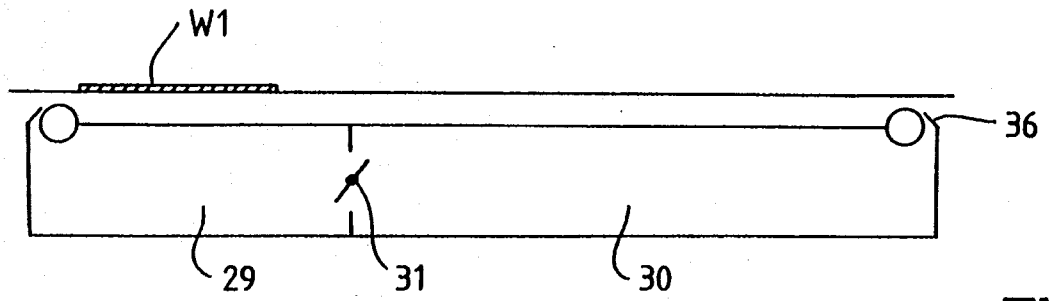

The same way as in FIG. 9, said box 25 is divided into two sections 26 and 27. The sections are in communication with each other through the action of a regulating damper 35. As for its operation and disposition, the box section 26 is identical to what is shown in FIGS. 7 and 8 and it is provided with blast nozzles 20–23 operating in the same way with a bearing surface 6. The end of box section 27 facing the traveling direction of fabric F1 is provided with a nozzle 28, directed against the fabric traveling direction and against a nozzle 21 which is in communication with section 26. In addition, at the fabric edges between nozzles 21 and 28 there are nozzles 36 (FIG. 13), directed towards the center. The slit orifice of nozzles 21, 28 and 36 has a width S which is generally 1 . . . 8 mm, preferably about 1 . . . 5 mm. The opposing air jets discharging from slit orifices 28, 36 and 21 produce an over-pressure in a space $H_3$ therebetween, defined by fabric F1 and also defined in the direction perpendicular to the plane of the fabric by the fabric-facing wall of section 27 and in the direction parallel to the plane of the fabric by the nozzles. An air current generated by the action of over-pressure through the fabric forces web W or tail W1 to leave fabric F1 for fabric F2. Section 26 shown in FIG. 12 can be divided in crosswise separated chambers according to the principle shown in FIG. 8. FIG. 13 shows the blow box 25 in a cross-section at sections 26 and 27. If necessary, section 27 can be further divided in crosswise separated sections 29 and 30, which are in communication with each other through the action of a regulating damper 31. The purpose of these separate sections is to increase the blowing of section 29 during the course of threading as the damper is shut off and air is flowing through the open damper 35 from section 26 into section 29 and, thus, to increase pressure within zone $H_3$ in alignment with tail W1.

Figure 14:
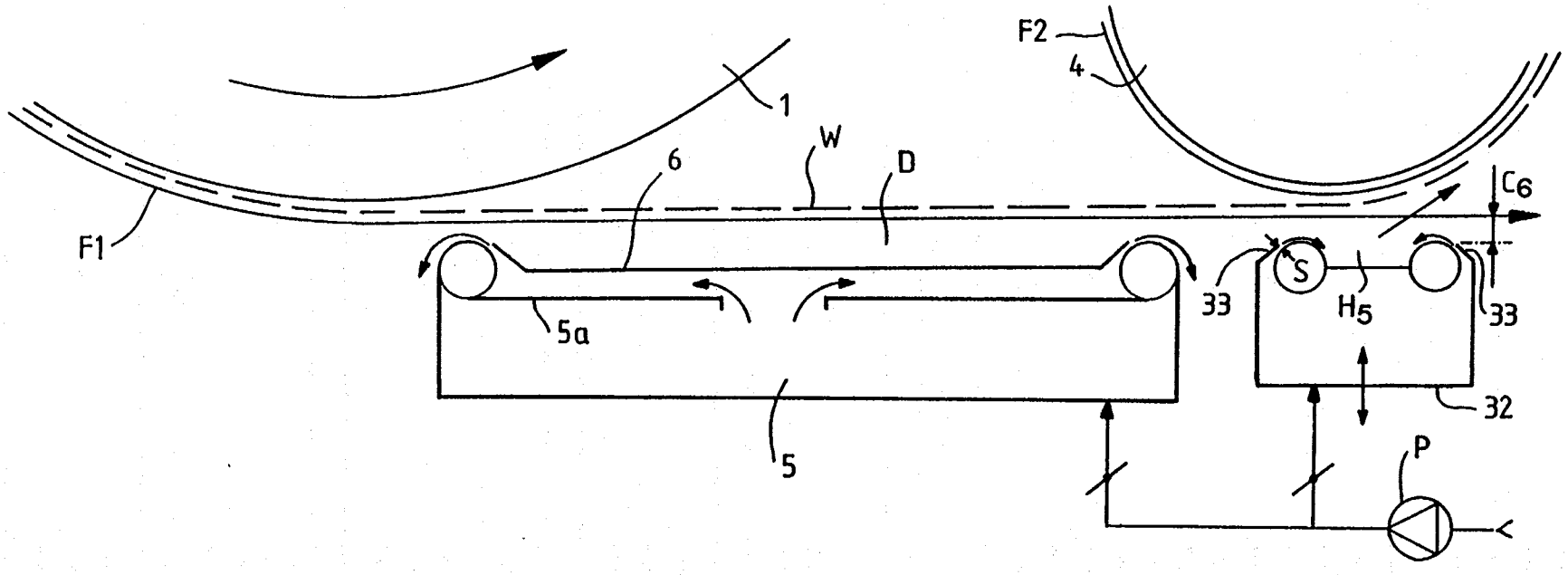
FIGS. 14, 15 and 16 show an apparatus of FIG. 6 in more detail as a section in the longitudinal direction and cross machine direction.

FIG. 14 shows one embodiment of the invention, wherein the web support between cylinder 1 and vacuum roll 4 is effected by means of an apparatus similar to what is shown in FIGS. 3, 7 and 8. The apparatus is further provided with a movable separate blow box 32, which is mainly used in conjunction with threading. Box 32 is connected to the same fan P as box 5. The box length in machine direction is generally 100–500 mm, preferably 100–300 mm. The ends and edges of the box are provided with slit orifices 33, directed towards the center and positioned the same way relative to the box wall and operate on the same principle as slit orifices 21, 28 and 36 directed towards plenum zone $H_3$ in FIGS. 12 and 13.

Figure 15:
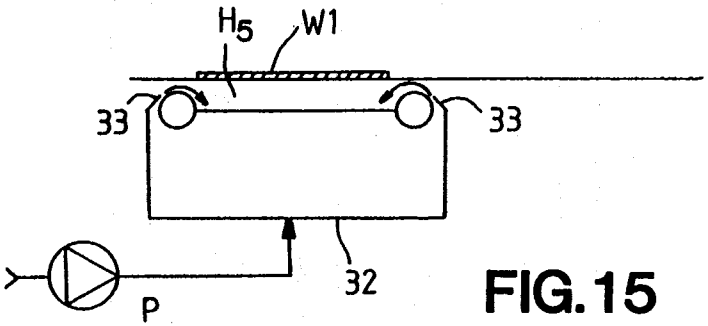

FIG. 15 illustrates the movable blow box 32 as a cross-section in the cross-machine direction. The box has a width at least equal to that of tail W1, generally within the range of 400–1500 mm, preferably 500–800 mm. In a threading situation, the box is carried to the proximity of dryer fabric F1 such that a clearance $C_6$ (a gap between slit orifice edge and fabric F1) is generally within the range of 5–20 mm, preferably 5–10 mm.

Thus, when effecting a blow from nozzles 33 (FIGS. 14 and 15), the air currents create an ejection flow and, thus, the pressure increases within a zone $H_5$ defined by the slit orifices and the fabric-facing wall of box 32 and the over-pressure or plenum pushes tail W1 from fabric F1 onto fabric F2.

Figure 16:
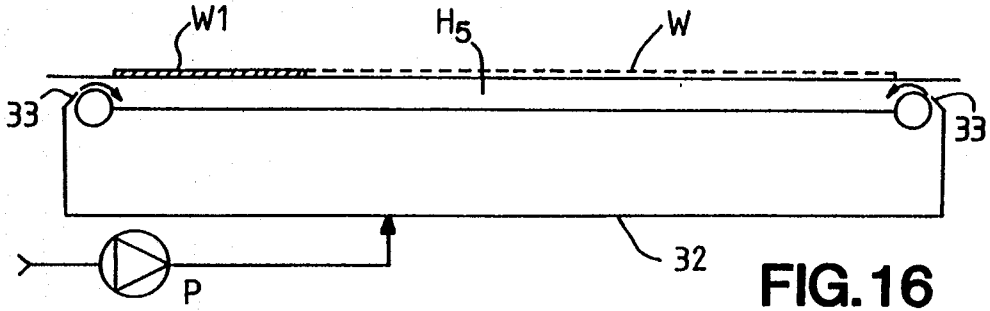

FIG. 16 illustrates one embodiment of blow box 32, wherein the box has a width in the cross-machine direction at least equal to that of web W of paper. Otherwise the structure is identical to what is shown in FIGS. 14 and 15.

Figure 17:
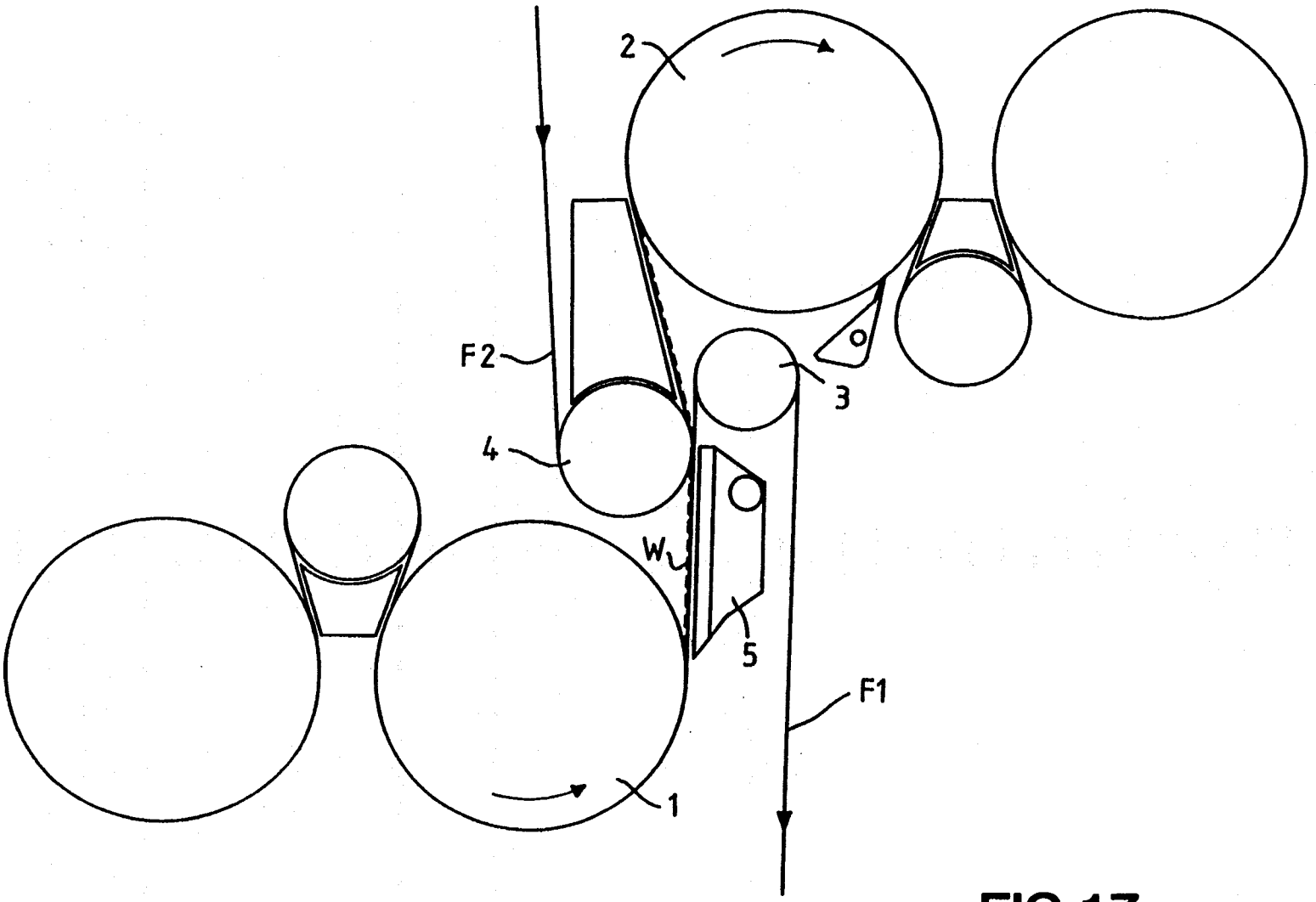
FIG. 17 shows an alternative disposition of the apparatus.

The above description deals with a solution with various embodiments of the apparatus included in a machine configuration as shown in FIGS. 3–6 between cylinder arrays or configurations disposed successively on the same plane, thus lying nearly horizontally inside a loop formed by first fabric F1 at reversing roll 3 and against the fabric section extending between cylinder 1 and reversing roll 3. FIG. 17 depicts another solution of the invention, wherein the blow and vacuum boxes can also be placed in a vertical position due to the fact that the dryer cylinder configurations are set at different levels and first fabric F1 travels vertically between cylinder 1 and reversing roll 3. The configuration of FIG. 17 may include and use all the blow and vacuum boxes and design solutions shown in the preceding figures.

We claim:

1. A method for eliminating the flutter of a paper web in the dryer section of a papermaking machine between two single felt configurations thereof, wherein said web is transferred from a dryer fabric of a first configuration onto a dryer fabric of a second configuration along a common run of said fabrics, the transfer being effected from one fabric to the other by means of a vacuum transfer roll, on which said second configuration dryer fabric is brought into contact with the web and around which said fabric is winding, comprising the steps of:

providing a vacuum zone on the side of said first configuration dryer fabric upstream of a contact point between the web carried thereon and the second configuration dryer fabric winding around the vacuum transfer roll, said vacuum zone being defined by said first configuration dryer fabric for retaining said web in contact with said first configuration dryer fabric, and blowing air at a location downstream of said contact point in the traveling direction of said first configuration dryer fabric, said air being blown from the side of said first configuration dryer fabric released from the web through the fabric into a gap formed between the second configuration dryer fabric lying on the vacuum transfer roll together with the web and the first configuration dryer fabric released from said web.

2. A method as set forth in claim 1, wherein a vacuum on the side of said first configuration dryer fabric is produced by means of the ejection effect of air blown from nozzles in the proximity of said first-configuration dryer fabric away from the vacuum zone.

3. A method as set forth in claim 1, wherein a vacuum on the side of said first configuration dryer fabric is produced by sucking air through a suction duct away from a closed space defined by said first configuration dryer fabric.

4. A method as set forth in claim 2, wherein at least some of the air blown from the nozzles participates in the formation of a plenum zone located downstream of the contact point and defined by a section of the first configuration dryer fabric released from the web for producing a blow through said fabric section into a gap formed between the dryer fabric lying on the vacuum transfer roll together with the web and the dryer fabric released from said web.

5. An apparatus for eliminating the flutter of a paper web in the dryer section of a papermaking machine between two single felt configurations thereof, said apparatus comprising:

a transfer point for transfering a web from a dryer fabric of a first configuration onto a dryer fabric of a second configuration along a common run of said fabrics, a vacuum transfer roll, around which said second configuration dryer fabric is adapted to wind and to be brought into contact with the web and along which the transfer point is located;

a surface located at a section of said first configuration dryer fabric upstream of a contact point between the web and said second configuration dryer fabric, said surface facing towards said section of said first configuration dryer fabric;

a first blowing means including a fan and a space connected therewith by a duct for developing a vacuum between said section and said surface, and a second blowing means, including a fan and space connected therewith by a blow duct, on the side of a section of the first configuration dryer fabric released from the web, said second blowing means being adapted to produce an air flow downstream of said contact point through the fabric into a gap formed between said second configuration dryer fabric lying on said vacuum transfer roll together with the web and said first configuration dryer fabric released from the web.

6. An apparatus as set forth in claim 5, wherein a space between the section of the first configuration dryer fabric upstream of said contact point and said surface facing said section is defined in the direction of the plane of the fabric by nozzles, included in the blowing means and directed away from said space for creating a vacuum by means of the ejection effect caused by an air flow discharging from the nozzles.

7. An apparatus as set forth in claim 5, wherein said space between the surface and said section of the first configuration dryer fabric is coupled by way of a suction duct with a fan for creating a vacuum in said space.

8. An apparatus as set forth in claim 6, wherein some of said nozzles included in the blowing means are directed towards a plenum zone located in alignment with the section of the first configuration dryer fabric released from the web, said nozzles contributing to an air flow through said section of the first configuration dryer fabric.

9. An apparatus as set forth in claim 8, further comprising second blowing means including nozzles which, together with one of said nozzles defining said space between said section of the first configuration dryer fabric upstream of said contact point and said surface, define in the direction of the plane of the fabric said plenum zone, which is formed between a surface included in said second blowing means and said fabric, said nozzles being directed towards said zone.

10. An apparatus as set forth in claim 9, wherein said space included in the blowing means and being in communication with the nozzles defining the space between the fabric and the surface, and said space included in the second blowing means and being in communication with the nozzles of the second blowing means, are joined together through the action of a flow regulating element for regulating between the spaces the distribution of the amount of air supplied by the blow duct extended into either one of the spaces and being in communication with the fan.

11. An apparatus as set forth in claim 10, wherein the blow duct is extended into the space included in the blowing means and separate from said second blowing means.

12. An apparatus as set forth in claim 5, wherein between a surface included in the second blowing means and the fabric is provided a plenum zone, which is defined in the direction of the plane of the fabric by nozzles, which are directed towards the plenum zone and in communication with a space included in the second blowing means.

13. An apparatus as set forth in claim 5, wherein said space included in the second blowing means is adapted to be movable independently of the space included in the first blowing means.

14. An apparatus as set forth in claim 5, wherein the action of said blowing means is restricted within or transferable to the area of a tail narrower than a full-width web and to the edge of the first configuration dryer fabric.

15. An apparatus as set forth in claim 14, wherein from the space of the blowing means is separated a secondary space located along the edge of the first configuration dryer fabric in alignment with the tail, said apparatus further comprising a regulating element for regulating the distribution of the action of the fan between the secondary space and a primary space constituting the space of the blowing means outside the secondary space.

16. An apparatus as set forth in claim 15, wherein between the secondary space and the primary space is provided a flow regulating element, one of the spaces being closer to the action of the duct in communication with the fan, the distribution of the action of the fan between the spaces being adapted to be controlled by means of said flow regulating element.

* * * * *